US008794297B1

(12) United States Patent
McNulty et al.

(10) Patent No.: US 8,794,297 B1
(45) Date of Patent: Aug. 5, 2014

(54) MOLDING APPARATUS AND METHOD OF FORMING A MOLDABLE ARTICLE

(71) Applicant: General Electric Company, Schenectady, NY (US)

(72) Inventors: Thomas Francis McNulty, Ballston Lake, NY (US); John Kost, Schenectady, NY (US); Xi Yang, Mason, OH (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 13/731,557

(22) Filed: Dec. 31, 2012

(51) Int. Cl.
*B22C 9/00* (2006.01)
*B22C 9/10* (2006.01)

(52) U.S. Cl.
USPC ..... 164/6; 164/228; 249/62

(58) Field of Classification Search
USPC ..... 164/6, 159, 228; 249/61, 62
See application file for complete search history.

(56) References Cited

U.S. PATENT DOCUMENTS

| | | | | |
|---|---|---|---|---|
| 4,362,686 | A * | 12/1982 | Clishem et al. | 264/317 |
| 4,491,169 | A * | 1/1985 | Durand-Texte | 164/418 |
| 6,403,020 | B1 | 6/2002 | Altoonian et al. | |
| 7,287,573 | B2 | 10/2007 | McNulty et al. | |
| 7,487,819 | B2 | 2/2009 | Wang et al. | |
| 7,732,526 | B2 | 6/2010 | McNulty et al. | |
| 2008/0135722 | A1 | 6/2008 | Wang et al. | |

FOREIGN PATENT DOCUMENTS

| | | | | |
|---|---|---|---|---|
| JP | 7-300367 | A * | 11/1995 | C04B 35/49 |

* cited by examiner

*Primary Examiner* — Kevin P Kerns
(74) *Attorney, Agent, or Firm* — John P. Darling

(57) ABSTRACT

A molding apparatus is provided. The molding apparatus includes a first block configured to receive a moldable article therein, a second block positioned a distance from the first block, and a shim including graphite. The shim is positioned between the first block and the second block, wherein the shim gradually disintegrates when heated such that the second block contacts the first block.

20 Claims, 5 Drawing Sheets

MOLDING APPARATUS AND METHOD OF FORMING A MOLDABLE ARTICLE

BACKGROUND

The field of the present disclosure relates generally to forming moldable articles and, more specifically, to forming ceramic cores that may be used in an investment casting process.

At least some known metallic turbine components, such as blades, nozzles, and vanes, have complex internal and external geometries. For example, turbine blades and nozzles may have internal passages and/or voids defined therein that may be used for cooling purposes. These passages must be manufactured in accordance with accurate dimensions having tight tolerances. In such instances, investment casting is generally effective at manufacturing parts that require precise dimensional accuracy.

Manufacturing metallic turbine components generally requires the fabrication of a ceramic core that acts as a pattern and defines the internal cooling passages. Ceramic cores may be fabricated using any suitable ceramic processing method. Generally, ceramic powder is mixed with binders and/or volatile liquids to form a slurry or plastic mixture. The mixture is then formed into a desired shape and cured in a molding process, such as an injection molding process. The formed green ceramic article is then subjected to one or more heat treatments to remove the volatile components and to sinter the ceramic material. The ceramic core may then be used in an investment casting process.

However, firing the green ceramic core generally results in shrinkage and deformation of the core such that the core dimensions may fall outside of acceptable tolerances. For example, a green ceramic core may be subjected to both sinter firing and setter firing processes. Sinter firing includes heating the ceramic core in a bed of sand or setter base, resulting in a partially-densified core that has been shrunk and deformed. The core is then setter fired using a two-piece (base and lid) setter in an attempt to use the principle of temperature creep to mold the core back within an acceptable tolerance range. However, the two-piece setter may result in core breakage in cases of extreme deformation. Core breakage may be partially remedied by positioning a number of wooden shims between the setter lid and base. The molding apparatus is then fired in a furnace such that the ceramic material reaches its glass transition temperature as the wooden shims burn away. Accordingly, the setter lid gradually moves into a desired molding position on top of the core. However, burning wood leaves a quantity of ash that facilitates preventing the lid and base from coming into direct contact with one another thereby creating a dimensionally inaccurate article.

BRIEF DESCRIPTION

In one aspect, a molding apparatus is provided. The molding apparatus includes a first block configured to receive a moldable article therein, a second block positioned a distance from the first block, and a shim including graphite. The shim is positioned between the first block and the second block, wherein the shim gradually disintegrates when heated such that the second block contacts the first block.

In another aspect, a method of forming a moldable article is provided. The method includes configuring a first block to receive the moldable article therein, positioning a second block a distance from the first block, positioning a shim including graphite between the first block and the second block, and heating the shim. The shim gradually disintegrates such that the second block contacts the first block.

DETAILED DESCRIPTION

Embodiments of the present disclosure enable forming a ceramic core in a setter block with improved dimensional accuracy. Ceramic cores are generally constructed by injecting or casting a ceramic slurry into a desired shape, curing the ceramic slurry, and densifying the core in a setter block in a setter firing process. In the exemplary embodiments, the setter core mold includes a first block (base), a second block (lid), and shims positioned therebetween. Because investment casting cores are generally constructed of a ceramic material that is brittle at room temperature, and because green ceramic cores are slightly oversized to accommodate shrinkage during the subsequent firing processes, the shims are used separate the second block from the first block. In the exemplary embodiment, the shims create separation between the second block and the core such that the weight of the second block does not damage the core prior to setter firing.

Setter firing includes heating the setter block and core in a furnace to a temperature that facilitates sintering the ceramic core. In the exemplary embodiments, the shims are constructed from high-purity graphite that disintegrates slowly when heated in the furnace. As such, the second block that rests upon the shims gradually settles into contact with the first block over the core. The temperature of the furnace is raised, but controlled, such that the glass transition temperature of the ceramic core is reached before the shims disintegrate completely. Accordingly, at these temperatures, the core material has viscous creep capabilities such that the setter block forces the core to retain its shape and to counteract deformation resulting from firing shrinkage. Further, high-purity graphite burns cleanly when heated leaving substantially no ash residue between the blocks. By leaving substantially no ash residue, dimensionally accurate and solidified cores that conform to acceptable industry tolerances of at least about ±0.254 mm are produced.

Figure 1:
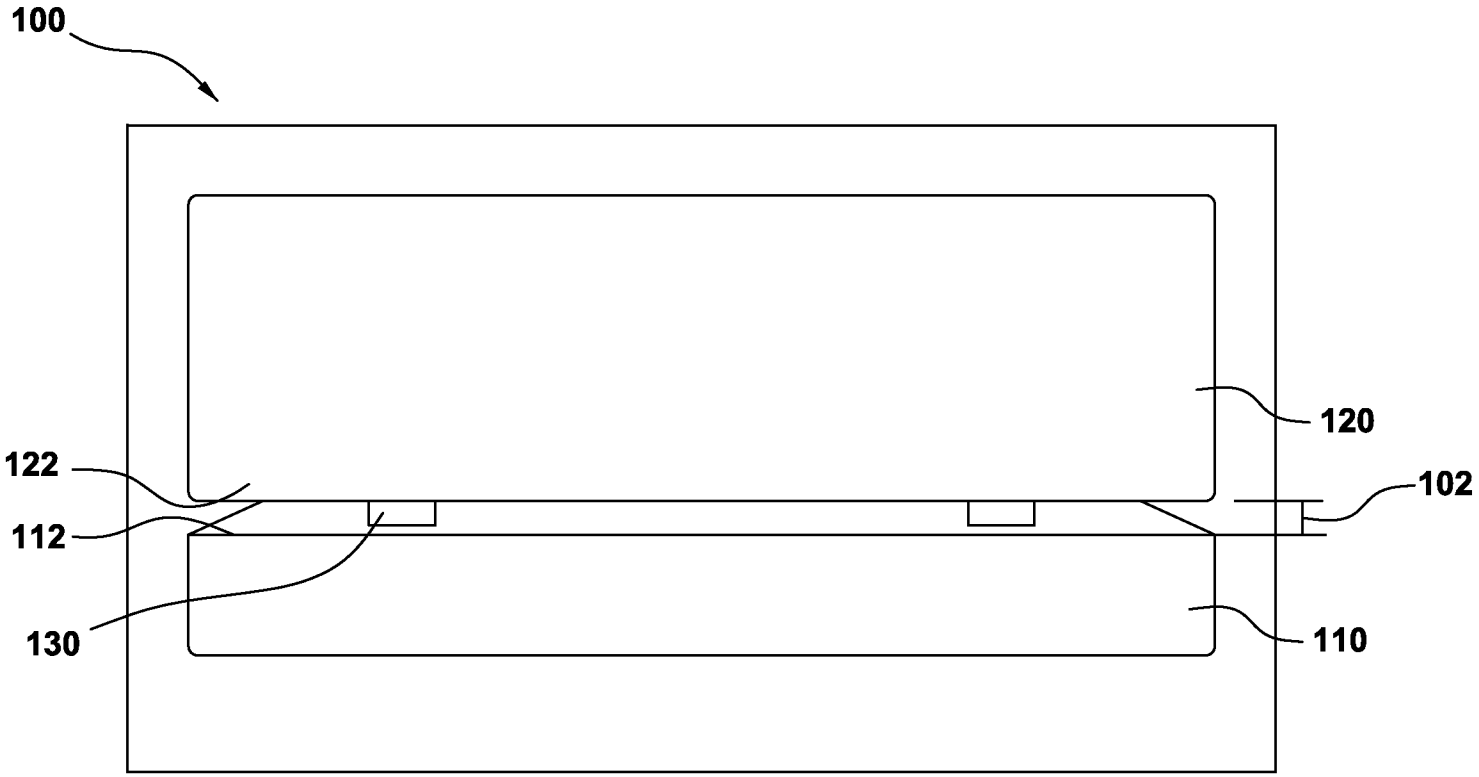
FIG. 1 is a side view of an exemplary setter block in a pre-firing configuration.

FIG. 1 is a side view of a setter block 100 in a pre-firing configuration. In the exemplary embodiment, setter block 100 includes a first block 110, shims 130 positioned about the periphery of first block 110, and a second block 120 positioned on top of shims 130. In one embodiment, shims 130 are positioned between contact surfaces 112 and 122 of blocks 110 and 120, respectively. Further, shims 130 have a thickness that facilitates positioning second block 120 a distance 102 from first block 110 such that a brittle moldable article may be positioned therebetween without being damaged by the weight of block 120. Further, setter block 100 may include any suitable number of shims 130 that enables setter block 100 to function as described herein.

Shims 130 may be constructed of any suitable material that enables setter block 100 to function as described herein. A suitable material includes, but is not limited to, high-purity graphite. As used herein, the term "high-purity graphite" refers to graphite having a carbon concentration of at least about 95 percent, at least about 96 percent, at least about 97 percent, at least about 98 percent, at least about 99 percent, at least about 99.5 percent, at least about 99.9 percent, and ranges thereof by weight based on the weight of shims 130. Accordingly, shims 130 include an ash concentration of less than about 5 percent, less than about 4 percent, less than about 3 percent, less than about 2 percent, less than about 1 percent, less than about 0.5 percent, less than about 0.1 percent, and ranges thereof by weight based on the weight of shims 130.

Further, shims 130 may have any suitable thickness that enables setter block 100 to function as described herein. For example, shims 130 have a thickness that separates second block 120 from first block 110 such that the weight of block 120 does not damage the moldable article prior to setter firing. In any of the various embodiments of the present disclosure, shims 130 have a thickness of at least about 0.5 mm, at least about 1.0 mm, at least about 1.6 mm, at least about 2.0 mm, at least about 3.0 mm, at least about 4.0 mm, at least about 5.0 mm, at least about 6.0 mm, and ranges thereof.

Figure 2:
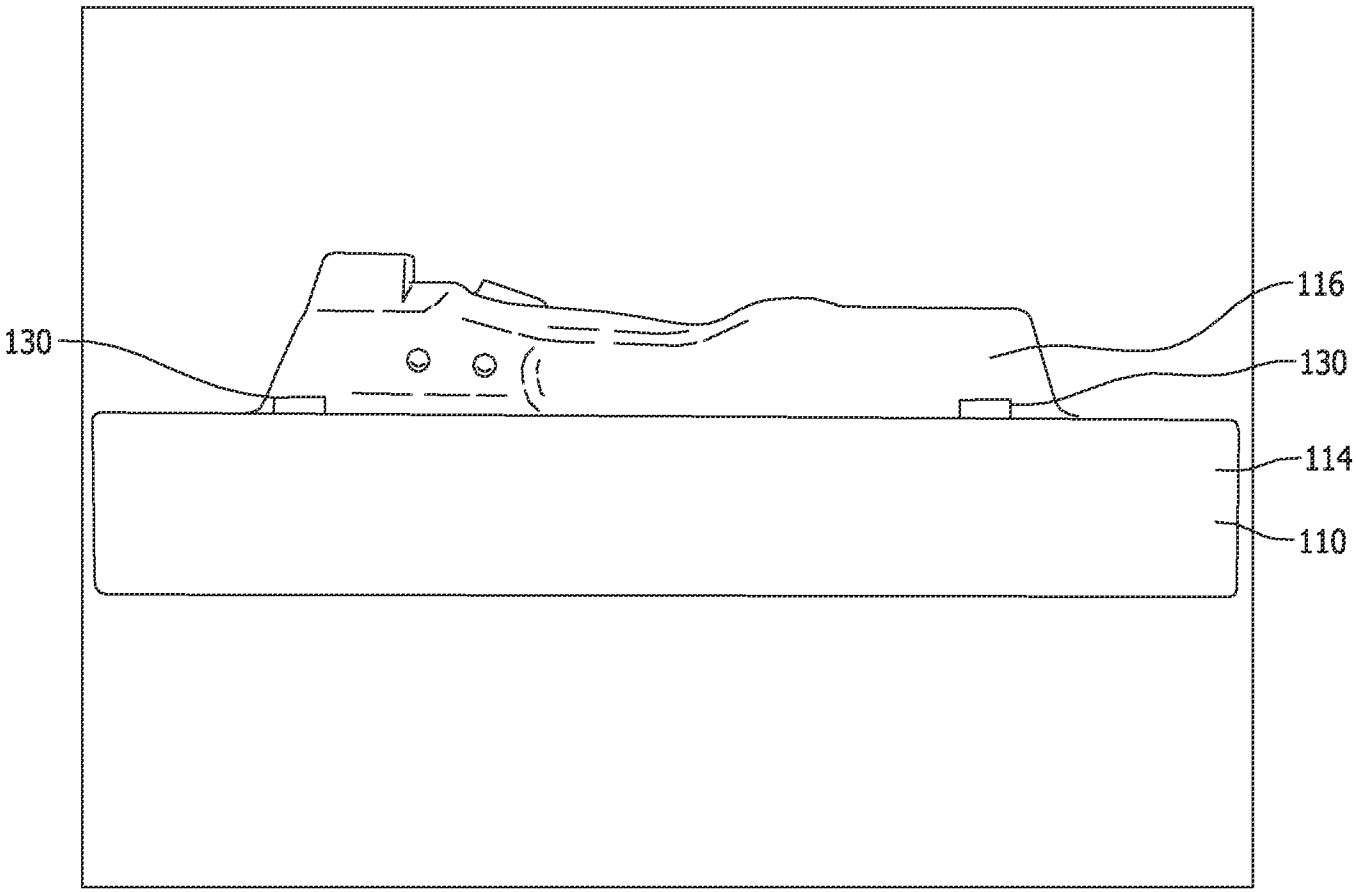
FIG. 2 is a side view of an exemplary first block of the setter block shown in FIG. 1.
Figure 3:
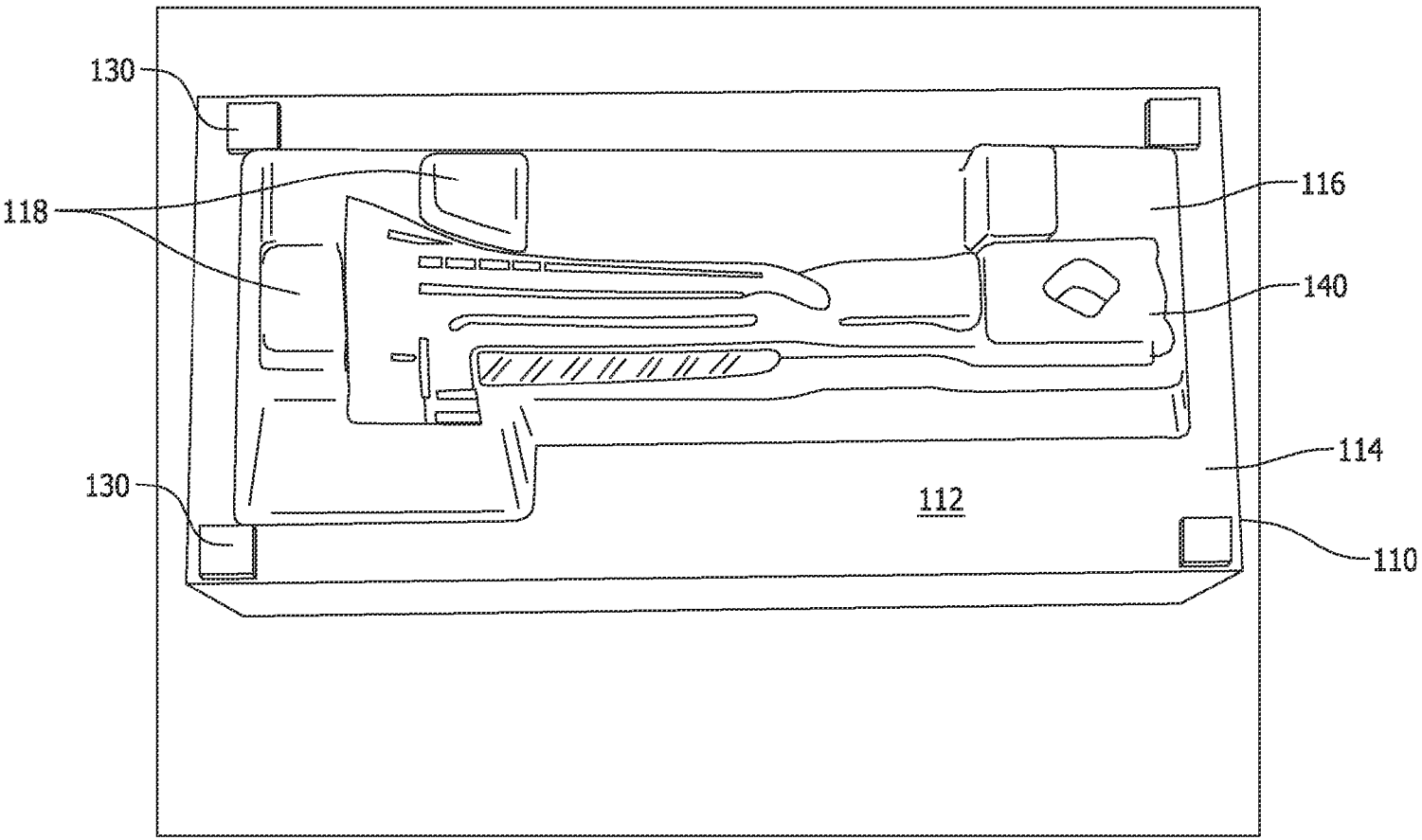
FIG. 3 is a perspective top view of the first block shown in FIG. 2.

FIG. 2 is a side view of first block 110 of setter block 100, and FIG. 3 is a perspective top view of first block 110. In the exemplary embodiment, block 110 includes a base 114, a raised mounting surface 116 that extends from base 114, and setter stops 118 that extend from mounting surface 116. Block 110 is configured to receive a moldable article therein such as, but not limited to, a ceramic investment casting core 140. Further, block 110 is configured to press against and force core 140 to retain its shape during a setter firing process. More specifically, core 140 is positioned on top of mounting surface 116 and positioned proximate to setter stops 118. Setter stops 118 are shaped to conform to the profile of core 140 to form core 140 into a dimensionally accurate ceramic core during the setter firing process.

While the configuration of first block 110 is described in detail herein, it should be understood that the configuration of second block 120 is substantially similar to block 110 according to this embodiment. Accordingly, second block 120 is configured to substantially mate with first block 110 when setter block 100 is in a post-firing configuration.

Figure 4:
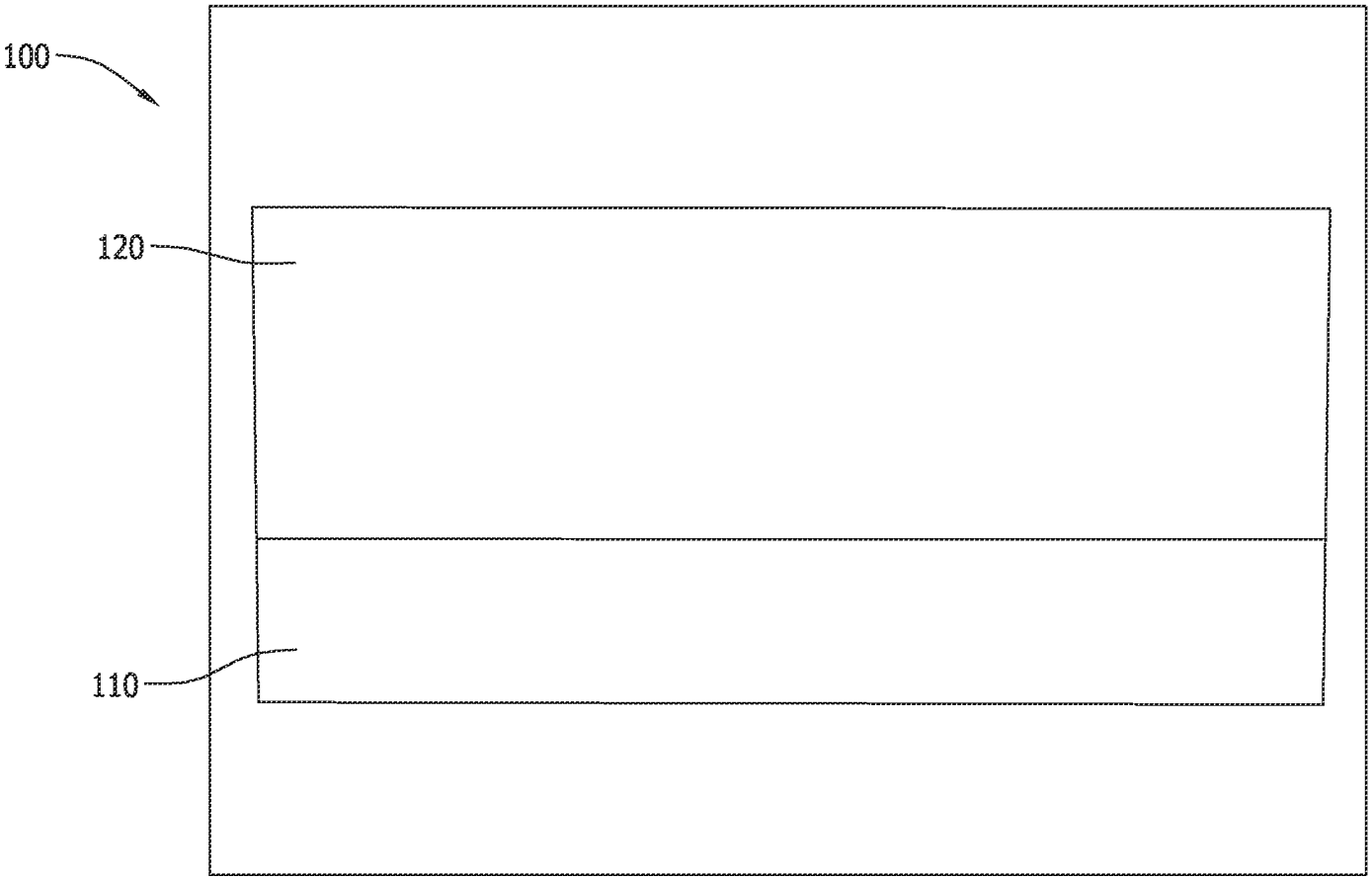
FIG. 4 is a side view of the setter block shown in FIG. 1 in a post-firing configuration.
Figure 5:
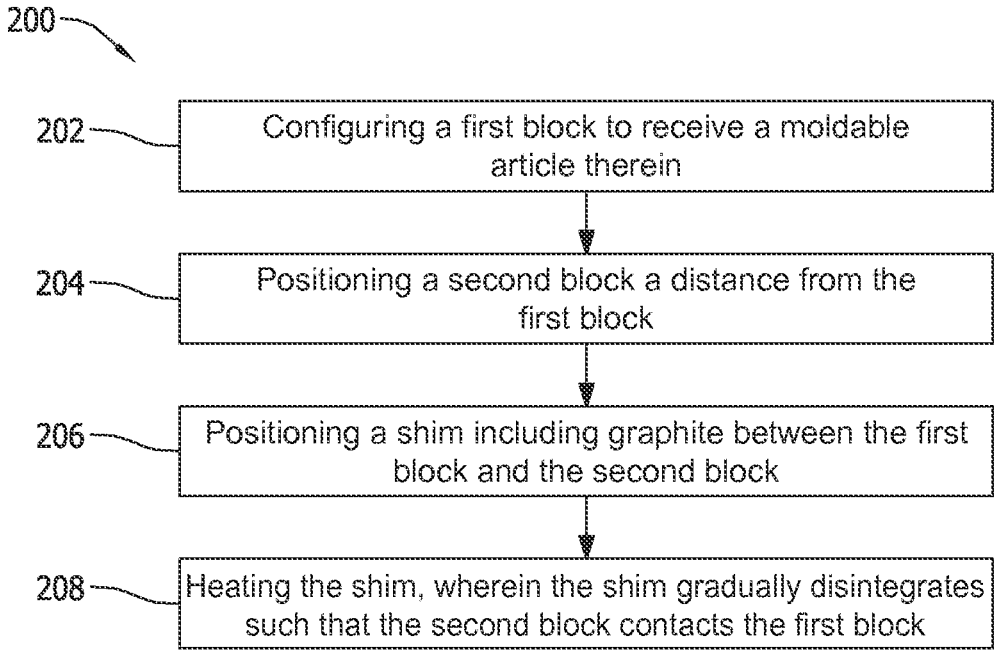
FIG. 5 is a flow diagram of an exemplary method of forming a moldable article that may be used with the setter block shown in FIG. 1.

FIG. 4 is a side view of setter block 100 in the post-firing configuration, and FIG. 5 is a flow diagram of a method 200 for forming a moldable article. In the exemplary embodiment, first block 110 is configured 202 to receive core 140 therein, second block 120 is positioned 204 a distance 102 from first block 110, and shims 130 (shown in FIG. 1) are positioned 206 therebetween such that setter block 100 is in the pre-firing configuration. Setter block 100 is then placed in a furnace (not shown) and heated 208 such that shims 130 gradually disintegrate, and such that ceramic material of core 140 reaches its glass transition temperature. As shims 130 gradually disintegrate, block 120 translates into position on top of block 110 and core 140 such that setter block 100 is in the post-firing configuration. Because shims 130 are constructed of high-purity graphite, heating 208 shims 130 in the furnace facilitates leaving substantially no ash residue between blocks 110 and 120. For example, in one embodiment, shims 130 completely disintegrate such that second block 120 directly contacts first block 110 without ash residue being positioned therebetween.

Further, the temperature of the furnace is controlled such that at least a portion of shims 130 are present when the glass transition temperature of core 140 is reached. In one embodiment, the temperature of the furnace is gradually increased at a rate of about 300° C./hour to a predetermined temperature of at least about 500° C. By increasing the temperature at such a rate, core 140 reaches its glass transition temperature before shims 130 completely disintegrate. As such, core 140 reaches its glass transition temperature before block 120 settles on top of block 110, thereby contacting core 140. When core 140 reaches its transition temperature, the ceramic material therein transitions from a solid-brittle state to a viscous state. As such, when core 140 is still in a solid-brittle state, second block 120 is separated from first block 110 with shims 130 to facilitate preventing damage to core 140.

When core 140 reaches the glass transition temperature and transitions to a viscous state, block 120 is allowed to settle into contact with block 110 and core 140. Because core 140 is in a viscous state, the weight of block 120 does not damage core 140. Instead, setter block 100 forces core 140 to retain its shape as it shrinks during setter firing. As mentioned above, the temperature within the furnace is increased at a rate that facilitates disintegrating shims 130 at a gradual rate. Accordingly, second block 120 moves into contact with first block 110 and core 140 at a translation rate that corresponds to the rate of disintegration of shims 130.

The setter core mold described herein facilitates creating ceramic cores having improved dimensional accuracy. More specifically, the setter block includes shims constructed of high-purity graphite that separates the lid and base of the setter block. By separating the lid and base, the graphite shims facilitate preventing damage to the ceramic core when the setter block is in a pre-firing configuration. Further, the graphite shims burn away completely when heated in a setter furnace such that the lid and base may directly contact each other when the setter block is in a post-firing configuration. As such, using graphite shims as described herein facilitates enabling the lid and base to form the ceramic core without being offset by ash residue resulting in dimensionally accurate ceramic cores.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A molding apparatus comprising:

a first block configured to receive a moldable article therein;

a second block positioned a distance from said first block; and a shim comprising graphite, said shim positioned between said first block and said second block, wherein said shim comprises at least about 95 percent carbon by weight based on the weight of the shim and gradually disintegrates when heated such that said second block contacts said first block.

2. The molding apparatus in accordance with claim 1, wherein said graphite shim comprises less than about 5 percent ash by weight based on the weight of the shim.

3. The molding apparatus in accordance with claim 1, wherein said graphite shim comprises less than about 1 percent ash by weight based on the weight of the shim.

4. The molding apparatus in accordance with claim 1, wherein said shim disintegrates leaving substantially no ash residue between contact surfaces of said first and second blocks.

5. The molding apparatus in accordance with claim 1, wherein said shim comprises a plurality of shims positioned about the periphery of said first and said second blocks.

6. The molding apparatus in accordance with claim 1, wherein the moldable article comprises ceramic material.

7. The molding apparatus in accordance with claim 1, wherein said shim has a thickness that separates said second block from said first block, wherein the distance therebetween is at least about 0.5 mm.

8. The molding apparatus in accordance with claim 1, wherein at least one of said first block and said second block comprises at least one setter stop positioned proximate the moldable article.

9. The molding apparatus in accordance with claim 8, wherein said at least one setter stop facilitates maintaining the dimensional accuracy of the moldable article to within a tolerance of about 0.254 mm.

10. A method of forming a moldable article, said method comprising:

configuring a first block to receive the moldable article therein;

positioning a second block a distance from the first block;

positioning a shim including graphite comprising at least about 95 percent carbon by weight based on the weight of the shim between the first block and the second block; and heating the shim, wherein the shim gradually disintegrates such that the second block contacts the first block.

11. The method in accordance with claim 10 further comprising heating the moldable article to at least the glass transition temperature of the moldable article material, wherein the moldable article material includes ceramic material.

12. The method in accordance with claim 10, wherein heating the shim further comprises enabling the second block to directly contact the first block with substantially no ash residue therebetween.

13. The method in accordance with claim 10, wherein positioning a second block a distance from the first block comprises positioning the second block at least about 0.5 mm from the first block with the shim.

14. The method in accordance with claim 10 further comprising heating the first block, the second block, the moldable article, and the shim in a furnace.

15. The method in accordance with claim 14 further comprising controlling the temperature of the furnace such that at least a portion of the shim is present when the glass transition temperature of the moldable article material is reached.

16. The method in accordance with claim 14, wherein controlling the temperature of the furnace comprises gradually increasing the temperature of the furnace to a predetermined temperature.

17. The method in accordance with claim 16, wherein controlling the temperature of the furnace comprises heating the furnace to the predetermined temperature of at least about 500° C.

18. The method in accordance with claim 14 further comprising forcing the moldable article to substantially retain the shape thereof when heated in the furnace.

19. The method in accordance with claim 10 further comprising maintaining the dimensional accuracy of the moldable article to within a tolerance of about 0.254 mm.

20. The method in accordance with claim 10 further comprising moving the second block into contact with the first block at a translation rate that corresponds to a rate of disintegration of the shim.

* * * * *